United States Patent [19]

Flood

[11] 4,403,278

[45] Sep. 6, 1983

[54] MOUNTING SYSTEM FOR SUSPENDED LIGHTING FIXTURES

[75] Inventor: Thomas W. Flood, Hanover Park, Ill.

[73] Assignee: Harvstone Manufacturing Corporation, Elk Grove Village, Ill.

[21] Appl. No.: 324,642

[22] Filed: Nov. 25, 1981

[51] Int. Cl.[3] ..... F21V 21/00

[52] U.S. Cl. ..... 362/396; 362/368; 362/370; 362/371; 362/404

[58] Field of Search ..... 362/368, 370, 371, 396, 362/404

[56] References Cited

U.S. PATENT DOCUMENTS 3,700,887 10/1972 Marx ..... 362/396

4,173,037 10/1979 Henderson et al. ..... 362/368

4,363,086 12/1982 Fletcher ..... 362/368

*Primary Examiner*—Stephen J. Lechert, Jr.

*Attorney, Agent, or Firm*—Laff, Whitesel, Conte & Saret

[57] ABSTRACT

A mounting system has a box which is open at one end and a plate dimensioned to cover the opening. A disengagable pivot is positioned at one edge of the box and plate. A hooking mechanical connection is located at the opposite end of the box and plate. The light fixture is attached to the system and the system is in turn attached to an overhead structure. The plate and box engage each other at the pivot so that the plate does not initially cover the open end of the box. Thereafter, the plate may be rotated on the pivot and be secured against the open end of the box by the hooking mechanical connection.

13 Claims, 12 Drawing Figures

MOUNTING SYSTEM FOR SUSPENDED LIGHTING FIXTURES

BACKGROUND OF INVENTION

This invention relates to mounting systems for industrial lighting fixtures and more particularly to such systems for hanging light fixtures from overhead structures.

It is often desirable to suspend electrical lighting fixtures from overhead structures such as ceilings or exposed ironwork. Typically, in order to meet certain safety regulations, the electrical wiring to the lighting fixture must be run through metal conduit and metal junction boxes. The junction boxes are used where the pieces of conduit or the wires within the conduit must be joined. Often, the conduit and junction boxes are used to provide the mechanical structure by which to suspend the light from the overhead structure.

For example, a junction box is attached to an overhead structure by means of screws or other threaded fasteners. A conduit with electrical supply wires is run through the conduit and the wires are thus terminated within the box. The lamp assembly is mechanically suspended from the junction box and the wires connected to the lamp are spliced to the electrical supply wires within the junction box. The box is not always mechanically connected directly to the overhead structure but may be suspended from it by means of a pipe or second electrical conduit.

The installation of such lighting systems is time consuming and somewhat dangerous. The junction box must first be installed either on or suspended from the overhead structure with the electrical supply wires terminated within the box. In practice this will mean that such a box is located high above the floor of the room. The fixture must be carried up a ladder or scaffold by the electrician installing it and he must make the mechanical and electrical connections between the junction box and the lamp. Usually the junction box is open at the bottom and the lamp is attached to a plate which can be fixed, by means of screws, to the bottom of the junction box. Short lengths of wire from the electrical supply are located in the junction box and corresponding short wires from the lamp assembly are positioned at the side of the plate which will be enclosed in the box. The electrician must hold the plate with the lamp attached in close proximity to the box while splicing the wires. This operation is often carried out in precarious conditions. Depending on circumstances, it may require that the electrician balance the lamp on the ladder, that he hold it in one arm while splicing the wires with the other, or that he enlist the aid of a helper to position the lamp and plate.

After the wires are spliced, the plate must be secured to the box by means of screws or other threaded fasteners. Again this is awkward since the screws must be fitted while the plate and lamp are held in proper alignment with the box. There is the possibility that the screws, the lamp, or tools will be dropped. Even worse, the operation often requires the electrician to assume an awkward and unbalanced position on top of the ladder or scaffold. This causes an increase in the likelihood that he will fall.

The above mentioned shortcomings are not only present when the fixture is installed. The lighting fixtures sometimes have to be removed for repair or the wires within the junction box must be inspected. In such cases the junction box must be opened. If the fixture is to be removed the wires must be disconnected.

For all their shortcomings, the mounting systems described above are relatively sturdy once assembled since the various parts are attached to the junction boxes with screws. There is little danger of the plate and connected lighting fixture becoming dislodged due to inadvertent acts of the electrician, vibration, or objects striking the fixture.

It would be advantageous to retain the sturdiness of the mounting systems presently in use while overcoming their shortcomings.

Hence, an object of the present invention is to provide new and improved mounting systems for suspended lighting fixtures which enables rapid, convenient and safe installation or removal.

A further object is to provide mounting systems for suspended lighting fixtures which may be assembled or disassembled while workmen are above ground without the use of tools.

Also an object of the invention is to provide for suspended lighting fixtures, by means of a plate attached to a lamp assembly so that the plate may be pivotably attached to the remainder of a junction box while allowing access to the interior of the box and to the wires therein and which thereafter may be closed without the use of tools.

It is yet another object to provide mounting systems for suspended lighting fixtures, in a manner which requires components to be moved in two different directions in order to close or open and thereby prevent inadvertant dislodgement of the component parts.

SUMMARY OF THE INVENTION

The invention in one form comprises a box which is open at one side and a plate dimensioned to cover the opening. A disengagable pivot is positioned at one end of the box and plate. A hooking means is located at the opposite end of the box and plate. The lighting fixture is attached to the system and the system is attached to the overhead structure. The plate and box are dismountably engaged at the hinge so that the plate does not initially cover the open end of the box. Thereafter, the plate may be swung on the pivot to a position wherein the plate is secured against the open end of the box and latched in place by the means of a hooking mechanical connection.

BRIEF DESCRIPTION OF THE DRAWINGS

The above mentioned and other features of this invention and the manner of obtaining them will be best understood by reference to the following description taken in conjunction with the accompanying drawings in which.

DESCRIPTION OF THE EMBODIMENTS

Figure 1:
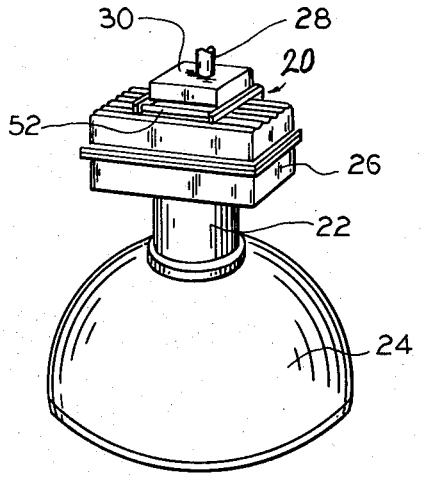
FIG. 1 is a perspective view of the inventive system showing a light fixture suspended from a conduit.

As shown in FIG. 1, a mounting system 20 is used to suspend a lighting fixture 22 from an overhead structure. The fixture includes a reflector 24 and a ballast 26. The mounting system is attached to a conduit 28 which depends from the overhead structure (not shown). The electrical wires which supply power to the lamp are inside the conduit 28. The splice between these wires and the wiring of the fixture is located within the mounting system.

Figure 2:
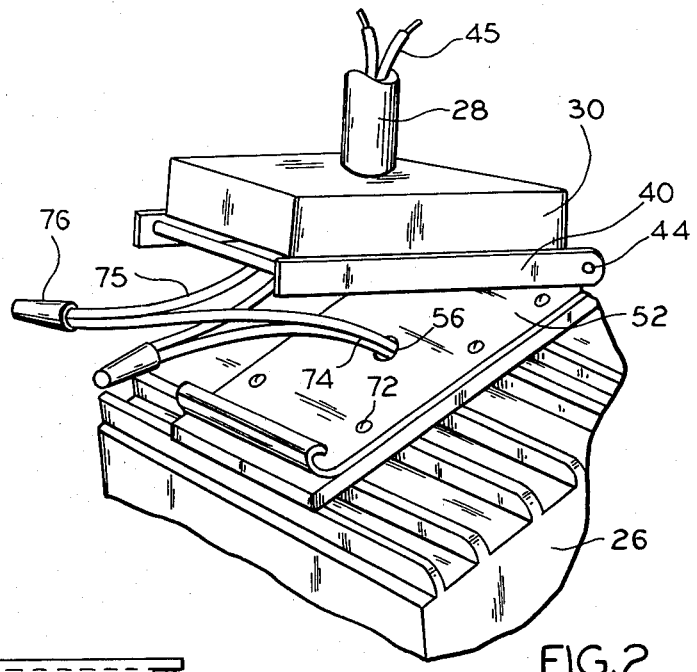
FIG. 2 is a perspective view of the mounting system in a open position, and part of an associated fixture, conduit and wires.

FIG. 2 illustrates the system in an opened position. As will be discribed in more detail below, the plate 52 is attached to the ballast 26 of the fixture and a support means in the form of a junction box 30 is attached to conduit 28. The box and plate are hingedly attached to each other by a disengageable pivotal connection 45.

Figure 3:
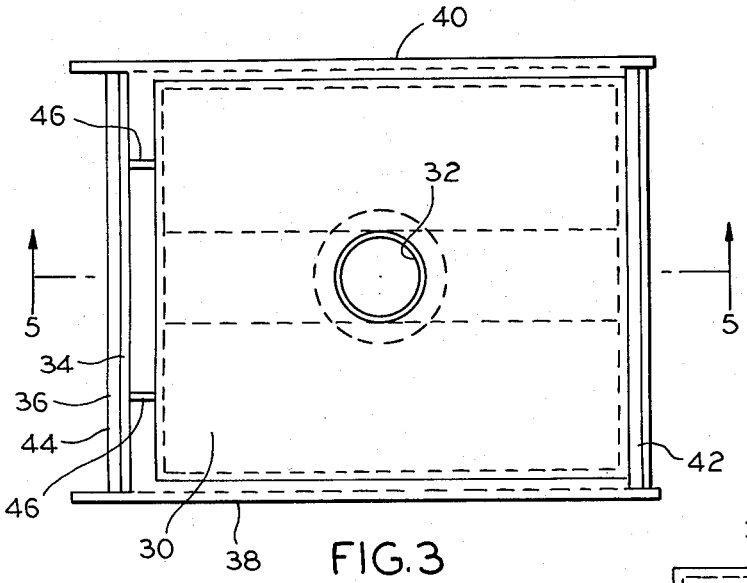
FIG. 3 is a top view of a first embodiment of the invention.
Figure 4:
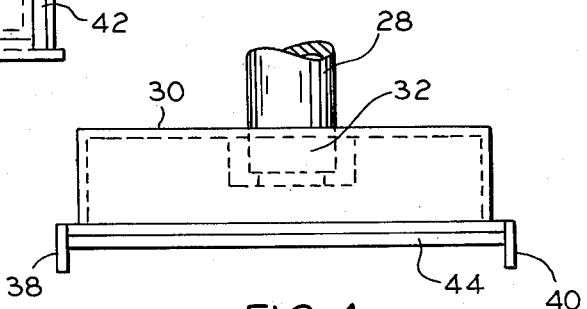
FIG. 4 is an end view of the box component of the system.
Figure 5:
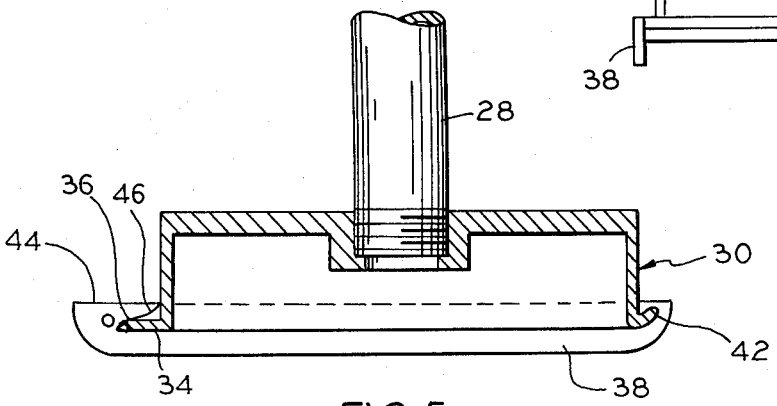
FIG. 5 is a cross sectional view taken along line 5—5 of FIG. 1 of the box.

FIGS. 3, 4, and 5 show a support means or junction box 30. It is preferably constructed of die cast aluminum, is open at its bottom side, and is provided with a conduit port 32 at its top side. The conduit port 32 may be threaded in order to mate with a similarly threaded conduit 28. Alternatively, the port 32 may be left unthreaded and conduit 28 may be inserted through the port and the box 30 where it is secured by means of a nut or other fastener onto the end of the conduit 28.

The support or junction box 30 contains the splice between the electrical supply wires from the conduit 28 and the wires to the lamp fixture. Hence, the dimensions of the box should be chosen according to the number, gauge and length of the wires to be spliced.

The box 30 is provided with a horizontal lip 34, extending the length of the left side of the box and having a chamfered edge 36. A flange 38 extends below the front of the box 30 while a similar flange 40 extends below the rear of the box 30.

A ridge 42 protrudes diagonally upward from the right side of the box 30 and extends from the front flange 38 to the rear flange 40.

A rod 44, preferably integrally die cast with the box 30, is positioned parallel to the edge of left side of the box. The ends of the rod are secured in holes in the front and rear flanges 38 and 40.

Also positioned at the left side of the box 30 are two cam surfaces 46. These cam surfaces have generally concave faces. The profile of the cam surfaces is extended by the chamfered edge 36 of the lip 34.

Figure 6:
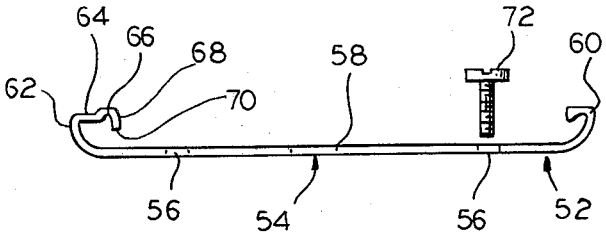
FIG. 6 is an end view of the plate.
Figure 7:
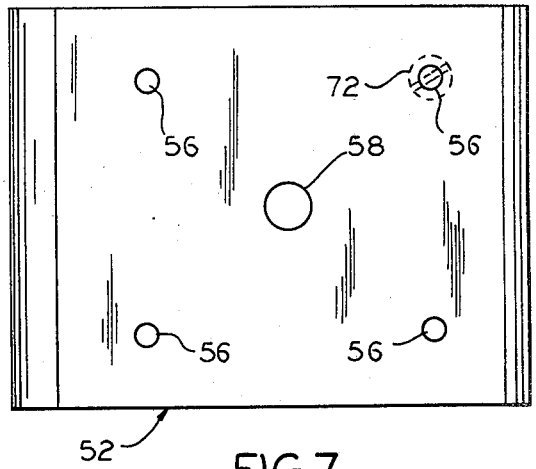
FIG. 7 is a top view of the plate.

FIGS. 6 and 7 show the plate 52, which is preferably formed of extruded aluminum. The main body 54 of the plate is generally planar and is provided with mounting screw holes 56. In this embodiment the holes provide a means for attaching the plate to the light fixture. The wires from the fixture pass through port 58 located in plate 52.

Figure 8A:
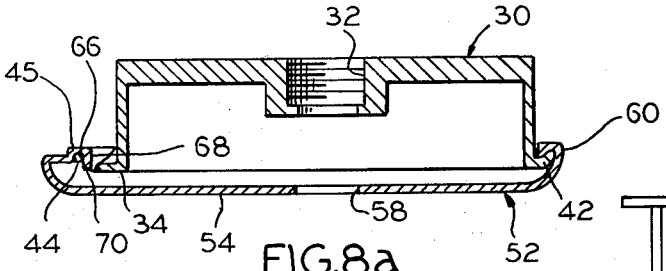
FIGS. 8*a*, 8*b*, and 8*c* are cross sectional views of the box and plate showing the sequence of motions by which the plate closes and opens over the end of the box.

As can be seen in FIGS. 6, 8*a*, the right side of the plate has a latch means in the form of hooking element 60, which is dimensioned to fit over the ridge 42 at the right side of box 30. The left side 62 of the plate comprises an upper horizontal wall 64, a notch 66 and a descending wall 68 having a distal end 70. The left side 62 of the plate cooperates with the left side of the box.

Figure 8B:
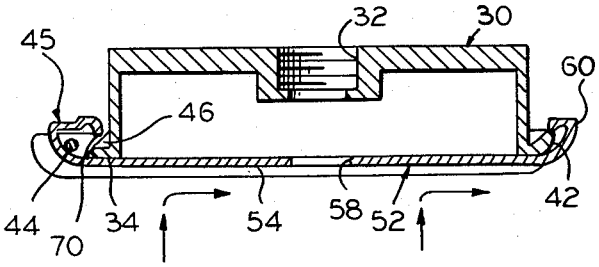
Figure 9:
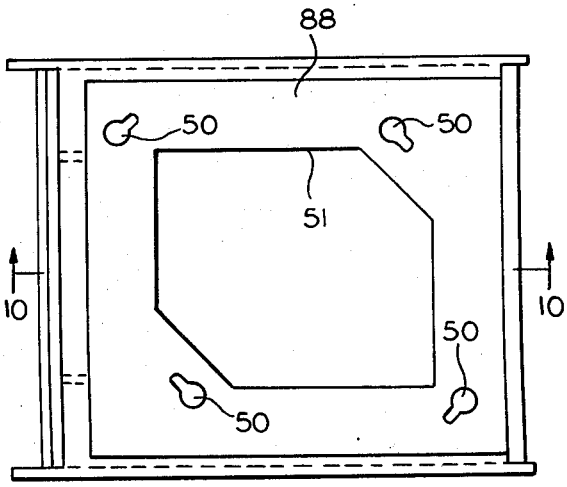
FIG. 9 is a top view of an alternate embodiment of the invention.
Figure 8C:
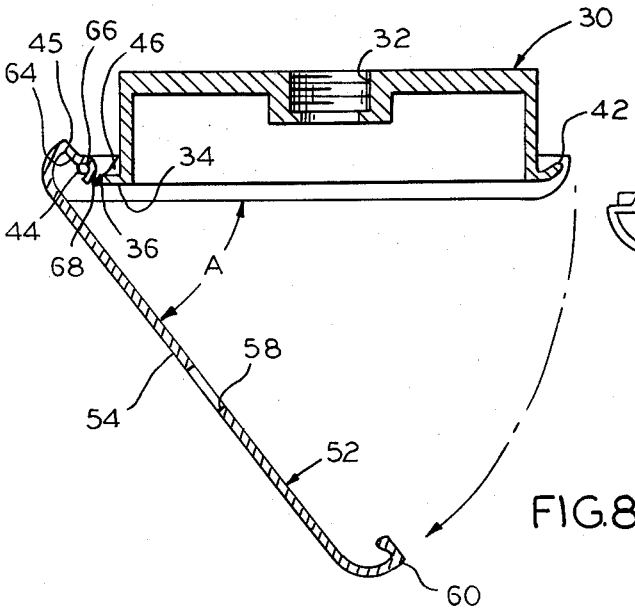

FIGS. 8*a*, 8*b*, and 8*c* illustrate the operation of the plate 52 and box 30. The system is shown moving from a closed to an open position since this more clearly illustrates the dimensioning of the plate 52 and the box 30. For the sake of clarity, the lamp, conduit wires, wire connectors, etc. are not shown.

The closed position is shown in FIG. 8*a*. At the right side of the assembly the hooking element 60 fits over the ridge 42 to latch the plate 52 over the open side of box 30. The ridge and hooking element provide a mechanical connection between the box and the plate. At the left side, the notch 66 fits over the rod 44. The notch and rod provide a disengageable pivotal connection 45 between the box and plate. The distal end 70 of the descending wall 68 abuts the horizontal lip 34. The close fit of the end of distal descending wall performs two functions. First, it seals the box to assure that no dust or debris can enter it. Secondly, it helps prevent the plate from being moved toward the right, as illustrated, unless the left side of the plate is lifted so that the end distal 70 is above the horizontal lip.

The operation of disengaging the hooking element from the ridge is shown in FIG. 8*b*. It is necessary to move the right side of plate 52 upwardly and to the right. However, because of the positioning of the distal end 70 against lip 34, this cannot be accomplished unless the left side of the plate 52 is also raised.

Once both sides of the plate 52 are raised the plate can be moved to the right to disengage and unlatch the hooking element 60 from ridge 42. It should be noted that as the plate is moved to the right the distal end 70 of descending wall 68 rides up the chamfered edge 36 of the lip and up the cam surface 46. The horizontal wall 64 is positioned above the rod 44.

Once the hooking structure has been unlatched and disengaged, the plate swings on the pivot to the open position shown in FIG. 8*c*. It should be noted that the distal end 70 slides down the cam surfaces 46 and the chamfered edge 36. This ensures that the notch 66 is automatically directed against the rod 44 even if no special care is taken to position it.

When the lamp is attached to the plate, the plate assumes approximately the oblique angle A as shown in FIG. 8*c*. When the plate is in this position the descending wall 68 abuts the chamfered edge 36 of horizontal lip 34. This prevents the plate from shifting downwardly and disengaging the notch 66 from the rod 44. Thus the notch is correctly positioned over the rod for when the plate is to be closed over the box.

The procedure to close the box is simply the reverse of the procedure to open it. During initial assembly the plate must be first positioned on the box to mate the notch 66 and rod 44 shown in FIG. 8*c*. The plate 52 need only be positioned so that the descending wall 68 is against the cam surfaces 46 and then moved downwardly to the position shown in FIG. 8*c*. The plate is then swung upwardly about the rod 44. Once it is almost horizontal, plate 52 must be moved to the right so that the hook structure 60 passes over the ridge 42 as shown in FIG. 8*b*. Then the plate is moved to the left into the position shown in FIG. 8*a*.

An important feature is that the box cannot be opened unless the plate, and therefore the attached lamp, is moved in two distinct motions, which are upwardly and then to the right. Also, both the left and right sides of the plate must be elevated in order for the plate to be moved to the right. These motions cannot occur responsive to gravity acting on the weight of the lamp. This feature reduces the possibility that the plate will become unhooked accidently by an inadvertent action of an electrician, vibration, or an object striking the attached lighting fixture.

The initial installation of the system will now be described in conjunction with the FIGS. 2 and 8*a*, 8*b*, and 8*c*.

It is presumed that a conduit with electric supply wires protruding therefrom is suspended from an overhead structures such as the ceiling. The lighting fixture is to be suspended from the conduit and electrically connected to the supply wires.

The plate 52 is attached to the lighting fixtures by means of screws 72 (FIGS. 6, 7) inserted through the holes 56 and received by the lamp fixture (not shown in FIGS. 6, 7). In the installation illustrated in FIG. 2 the screws are inserted into tapped holes in the ballast assembly 26. The wires 74 from the fixture are passed through port 56 in plate 52. This operation can be performed at any place, as before the workman has to mount a stepladder, for example. The box 30 is attached to the conduit 28, in any convenient manner, as by turning a threaded conduit port onto the threads on the conduit, for example.

Finally, the system is assembled. The plate 52 (with fixture attached) is positioned so that the notch 45 (FIG. 8*a*) engages the rod 44. The plate 52 and box 30 assume the position shown in FIG. 2 and the wires 74, 75 are spliced, using wire nuts 76 or any other suitable techniques. The splicing is easily accomplished since the entire weight of the fixture is supported from the opened box. Also, the electrician has both hands free, and does not have to support or steady the fixture while the wire nuts 76 are put into place.

Once the splicing is completed the wires are tucked into the box and the plate closed over the box as described above.

Figure 10:
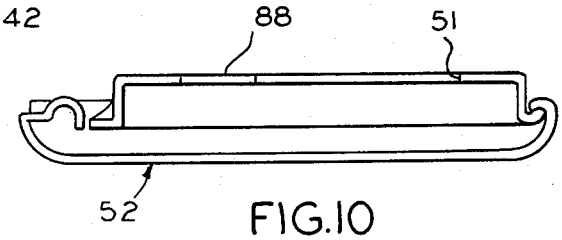
FIG. 10 is a cross sectional view along line 10—10 of FIG. 9 of an alternate embodiment of the invention.

FIG. 10 shows an alternate support means structure 88. Unlike the box 30 shown in FIGS. 3, 4, and 5, which may be suspended from the conduit, this support means 88 may be mounted flush against a ceiling or like surface. In practice, a conventional junction box (not shown) may be recessed above the ceiling with screws protruding from it. Support means on box 88 are connected to the junction box by slipping the protruding screws through holes 50. These holes 50 may have a keyhole or any other suitable shape. Still, other means for fastening the box to a ceiling structure or junction box may be used, where desirable. Aperture 51 is preferably dimensioned to match an opening in a conventional junction box. Since the spliced wires can be inserted through aperture 51 and positioned within the junction box, the support means on box 88 need not be as deep as box 30.

Variations to the invention are possible. For example, the plate could be attached to the conduit and the box attached to the lighting fixture. The plate or box may also be formed as an integral part of the fixture.

Also, the system may be used to suspend virtually any item, although it is particularly well suited for suspending other items requiring electrical connections. These other items may include T.V. monitors or cameras, and microphones or loudspeakers, or the like.

Those who are skilled in the art will readily perceive how to modify the system. Therefore, the appended claims are to be construed to cover all equivalent structures which fall within the true scope and spirit of the invention.

I claim:

1. A mounting system for suspending fixtures from overhead structures, the system comprising:

(a) support means having an open side with first and second opposing ends at the open side;

(b) plate means dimensioned to cover and conceal the open side of the support means with its first and second opposing ends covered by correspondingly opposing ends on said plate means;

(c) disengageable pivot means adjacent the first ends of said open side and said plate means for disengageable inter-connection of the support and plate means, said disengageable pivot requiring a predetermined sequence of horizontal and vertical movements of said plate relative to said support means in order to disengage said plate means from said support means;

(d) hooking means adjacent the second ends of said open side and plate means for latching said plate over said open side, said relationships being such that said plate hangs, but does not fall, from said support if said hooking means is accidentally unlatched;

(e) means for attaching a light fixture to the mounting system before said disengageable pivot means is engaged; and (f) means for attaching the mounting system to an overhead structure;

whereby the plate means and support means may be attached to each other at the disengageable pivot means without danger that said fixture may fall before the plate is closed against the open side, whereby after the pivot is engaged the plate may swing on the pivot and be secured by said hooking means against the open side, and whereby the lighting fixture must be lifted and shifted in order to disengage it from the support means.

2. The mounting system according to claim 1 wherein the disengageable pivot means includes a rod mounted on the support means and a notch formed on the plate means.

3. The invention according to claim 1 wherein the hooking means include a hooking element formed by an edge of the plate and a ridge formed on the support means which is engaged by the hooking element.

4. The invention according to claim 3 wherein the plate has a descending vertical wall which abuts a horizontal lip of the support means to prevent movement of the descending wall toward the lip unless the descending wall is first lifted over the lip and the hooking means cannot be moved away from the ridge unless the edge of the plate is lifted so that the hooking means may be moved over the ridge.

5. The invention according to claim 2 wherein the plate has a descending wall which abuts a horizontal lip of the support means when the plate sets at an oblique angle to the box to prevent the notch from becoming disengaged from the rod by movement of the plate in a direction parallel to its plane.

6. The invention of any one of the claims 1–5 wherein said support means is a junction box.

7. The invention of any one of the claims 1–5 wherein said support means is a cover member for closing a junction box.

8. A fixture support comprising support means having opposing edges, plate means for covering and concealing said support means, said plate means having opposing edges which are individually associated with corresponding opposing edges of said support means, a first pair of said individually associated edges having dismountable hinge means forming an interconnected hinge so that said plate and support means may be hingedly interconnected and then swing between opened and closed positions, said hinged interconnection being concealed by said plate when in said closed position and a second pair of said individually associated edges having latch means for securing said plate and support means while in said closed position, the hinge and latch and latch means being shaped and dimensioned so that said dismountable hinge means cannot become unhinged unless said plate and support means are first uniquely manipulated in both horizontal and vertical directions with respect to each other in a sequential manner which cannot normally occur responsive to a swinging of said plate on said hinge responsive to gravity acting on the weight of said fixture.

9. The fixture support of claim 8 wherein said shape and dimension of said hinge and latch include vertical and horizontal walls positioned so that said plate must be slid and lifted simultaneously to enable said vertical and horizontal walls to pass each other before said hinge means may be dismounted.

10. The system of claim 1 wherein each of said fixtures has associated therewith a closed box containing electrical parts, said plate means being attached to the exterior of said box, and means for enabling at least a pair of wires to be brought out of said box and through said plate means whereby said fixture may be electrically connected to or disconnected from an external circuit without exposing said electrical parts.

11. The system of claim 4 wherein each of said fixtures has associated therewith a closed box containing electrical parts, said support means is a junction box for use in an external electrical wiring circuit, and said plate means is attached to the exterior of said closed box, and means for enabling at least a pair of wires to be brought out of said box and through said plate means whereby said fixture may be electrically connected to or disconnected from said external electrical wiring circuit without exposing said electrical parts.

12. The system of claim 8 and a fixture having associated therewith a closed box containing electrical parts, said plate means being attached to the exterior of said closed box, and means for bringing at least a pair of wires out of said closed box and through said plate whereby said fixture may be electrically connected to or disconnected from an external circuit without exposing said electrical parts.

13. An electrical fixture comprising a closed box containing electrical parts required by said fixture, junction box support means for attachment to an overhead structure, plate means having opposing edges which are individually associated with corresponding opposing edges of said support means, said plate means forming an exterior part of said closed box means for bringing at least a pair of wires out of said box and through said plate means whereby said fixture may be electrically connected to or disconnected from an external circuit via said pair of wires and without having to open said box and thereby expose said electrical parts, a first pair of said individually associated edges having dismountable hinge means forming an interconnected hinge so that said plate means and said support means may be hingedly interconnected and then swing between opened and closed positions, and a second pair of said individually associated edges having latch means for securing said plate and support means while in said closed position, the hinge and latch means being shaped and dimensioned so that said dismountable hinge means cannot become unhinged unless said plate and support means are first uniquely manipulated in a predetermined sequence and with a lift and shift operation in both horizontal and vertical directions, said lift and shift operation being such that they cannot normally occur responsive to a swinging of said plate means on said hinge responsive to gravity acting on the weight of said fixture; whereby the plate means and support means may be attached to each other at the disengageable pivot means without danger that said fixture may fall before the plate is closed against the open side, whereby after the pivot is engaged the plate may swing on the pivot and be secured by said hooking means against the open side, and whereby the lighting fixture must be lifted and shifted in order to disengage it from the support means.

* * * * *